US011089429B1

(12) United States Patent
Trivedi

(10) Patent No.: US 11,089,429 B1
(45) Date of Patent: Aug. 10, 2021

(54) INDICATION FOR CORRECT AUDIO DEVICE ORIENTATION

(71) Applicant: Plantronics, Inc., Santa Cruz, CA (US)

(72) Inventor: Abhishek C. Trivedi, Pflugerville, TX (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 17/025,226

(22) Filed: Sep. 18, 2020

(51) Int. Cl.

| | |
|---|---|
| ***H04S 7/00*** | (2006.01) |
| ***H04R 5/04*** | (2006.01) |
| ***H04R 1/10*** | (2006.01) |
| ***H04R 5/033*** | (2006.01) |

(52) U.S. Cl.
CPC ..... *H04S 7/304* (2013.01); *H04R 1/1091* (2013.01); *H04R 5/04* (2013.01); *H04R 5/033* (2013.01); *H04R 2460/07* (2013.01)

(58) Field of Classification Search
CPC . H04R 5/033; H04R 5/04; H04R 1/10; H04R 1/1016; H04R 1/1041; H04R 1/1091; H04R 2420/07; H04R 2460/07; H04S 7/304
USPC ..... 381/74, 26, 309; 455/575.2
See application file for complete search history.

(56) References Cited

U.S. PATENT DOCUMENTS

| | | | | |
|---|---|---|---|---|
| 5,144,678 | A * | 9/1992 | Lenz | H04R 1/1041 381/371 |
| 6,792,116 | B2 * | 9/2004 | Liu | H04R 1/1041 368/12 |
| 8,073,153 | B2 * | 12/2011 | Loeppert | H04R 3/00 381/74 |
| 9,113,246 | B2 * | 8/2015 | Bastide | H04R 5/033 |
| 9,232,308 | B2 * | 1/2016 | Murata | H04R 1/1041 |
| 9,590,680 | B1 * | 3/2017 | Reuss | H04B 1/385 |
| 9,860,626 | B2 * | 1/2018 | Ergezer | H04R 1/1041 |
| 10,362,399 | B1 * | 7/2019 | Carino | H04R 5/033 |
| 10,555,066 | B1 * | 2/2020 | Bunney | H04R 1/1041 |
| 10,674,247 | B2 * | 6/2020 | Song | G06F 3/16 |
| 2004/0042629 | A1 * | 3/2004 | Mellone | H04R 1/1058 381/310 |
| 2013/0279724 | A1 * | 10/2013 | Stafford | H04R 5/04 381/309 |
| 2014/0314247 | A1 * | 10/2014 | Zhang | H04R 1/1041 381/74 |

OTHER PUBLICATIONS

"Lafitear Wireless Earbuds Bluetooth 5.0, Waterproof Sports Earphones w/Mic, Touch Control, Deep Bass Sound, One Step Pairing, in-Ear Headset for Sport/Travel/Gym", Retrieved Dec. 17, 2020 (9 pages) <https://www.amazon.com/Lafitear-Comfortable-Bluetooth-Multi-Size-Earphones/dp/B07XXYM173?th=1>.

* cited by examiner

*Primary Examiner* — Xu Mei
(74) *Attorney, Agent, or Firm* — Ferguson Braswell Fraser Kubasta PC

(57) ABSTRACT

A method may include obtaining a sensor value from a sensor of a headset, the sensor value indicating the headset being worn by a user; determining a current state of the headset; and in response to the current state and the sensor value, presenting a first directional indication with an earphone of the headset and starting a presentation timer, the first directional indication identifying a coupling type of the earphone of the headset, and the presentation timer preventing a second directional indication from being presented.

20 Claims, 8 Drawing Sheets

INDICATION FOR CORRECT AUDIO DEVICE ORIENTATION

BACKGROUND

Headsets provide audio to a user. Headsets may include earphones and channels for the left and right ears of a user. A headset may have a proper alignment on a user's head whereby the left and right ears of the user are aligned with the intended left or right earphones of headset. When aligned properly, the headset may perform better than when not aligned correctly. For example, the speakers on the headset may play the correct sound to the correct ear and a microphone on the headset may be able to better pick up the user's voice and perform noise cancellation. To inform users of the alignment, headsets use physical left and right markers on the earphones.

SUMMARY

In general, in one aspect, one or more embodiments relate to a method that includes obtaining a sensor value from a sensor of a headset, the sensor value indicating the headset being worn by a user; determining a current state of the headset; and in response to the current state and the sensor value, presenting a first directional indication with an earphone of the headset and starting a presentation timer, the first directional indication identifying a coupling type of the earphone of the headset, and the presentation timer preventing a second directional indication from being presented.

In general, in one aspect, one or more embodiments relate to a system that includes a processor, a memory, a sensor, and an earphone. The memory includes an application, wherein the application executes on the processor, uses the memory, and is configured for: obtaining a sensor value from the sensor, the sensor value indicating the system being worn by a user; determining a current state of the system; and in response to the current state and the sensor value, presenting a first directional indication with the earphone and starting a presentation timer, the first directional indication identifying a coupling type of the earphone, and the presentation timer preventing a second directional indication from being presented.

In general, in one aspect, one or more embodiments relate to a system that includes a processor, a memory, a sensor, a first earphone, and a second earphone. The memory includes an application, wherein the application executes on the processor, uses the memory, and is configured for: obtaining a sensor value from the sensor, the sensor value indicating the system being worn by a user; determining a current state of the system; in response to the current state and the sensor value, presenting a first directional indication with the first earphone and starting a presentation timer, the first directional indication identifying a coupling type of the first earphone, and the presentation timer preventing a second directional indication from being presented; and presenting the second directional indication using the second earphone after expiration of the presentation timer.

Other aspects of the invention will be apparent from the following description and the appended claims.

DETAILED DESCRIPTION

Figure 1A:
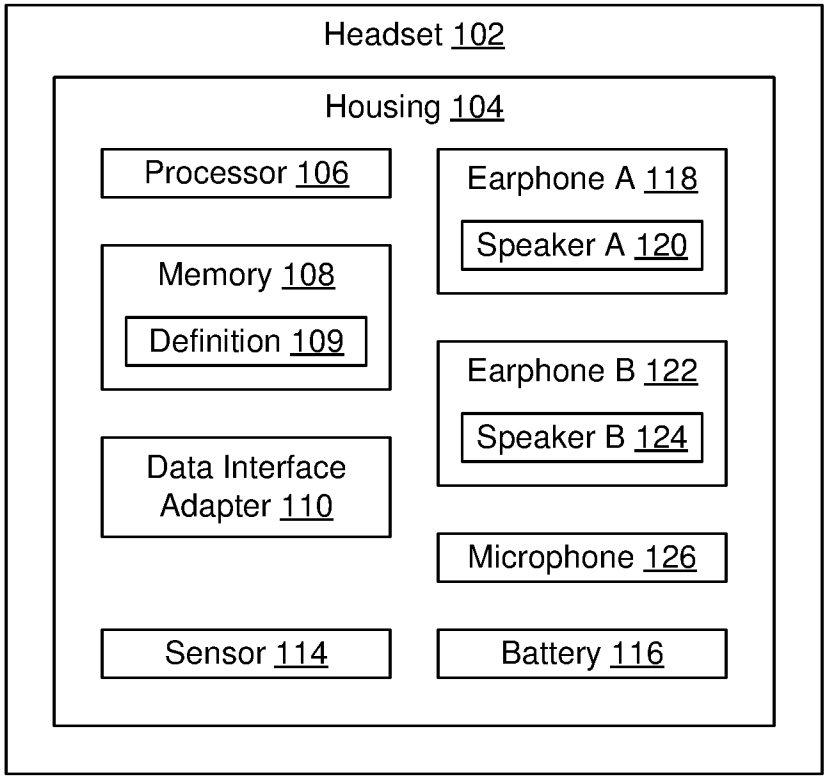
FIG. 1A, FIG. 1B, FIG. 2A, and FIG. 2B show diagrams of systems in accordance with disclosed embodiments.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, one or more embodiments headsets include one or multiple earphones that may be placed onto an incorrect ear of the user. For example, the user may unintentionally place the left earphone of a headset onto the right ear. Systems and methods according to the disclosure may play a directional indication through each earphone that identifies to the user the ear onto which the earphone should be placed. The headsets, which may include dual ear headsets and single ear headsets (also referred to as earbuds), detect when it is being worn by the user with a touch and proximity sensor that activates when a headset is worn. After the headset is put on by the user, the left earphone plays the left directional indication and then the right earphone may play the right directional indication.

Figure 1B:
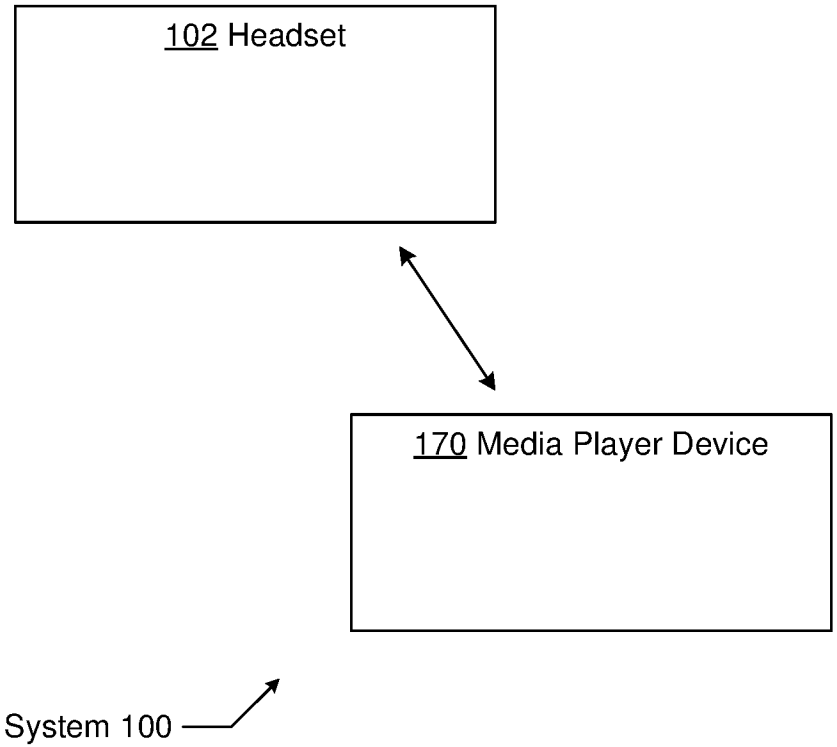
Figure 2A:
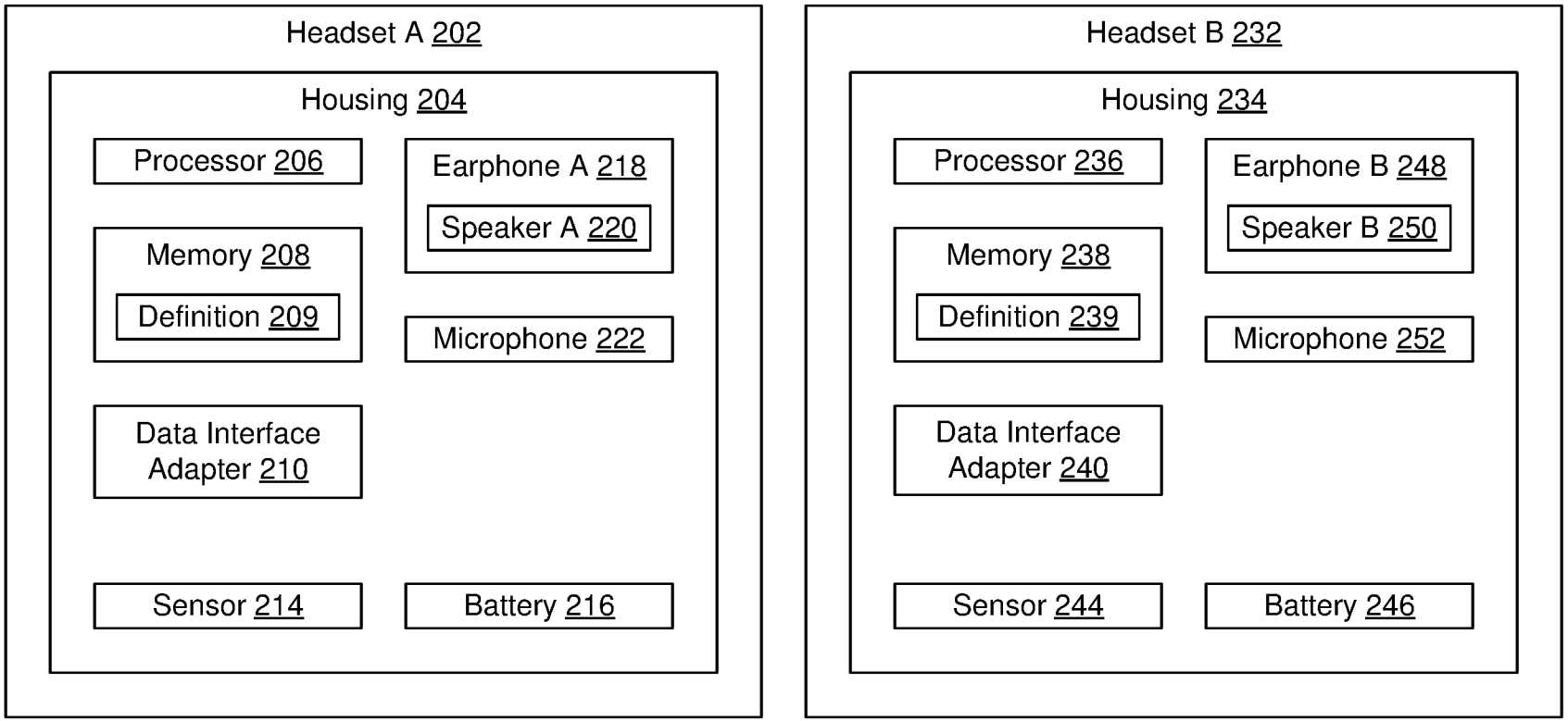
Figure 2B:
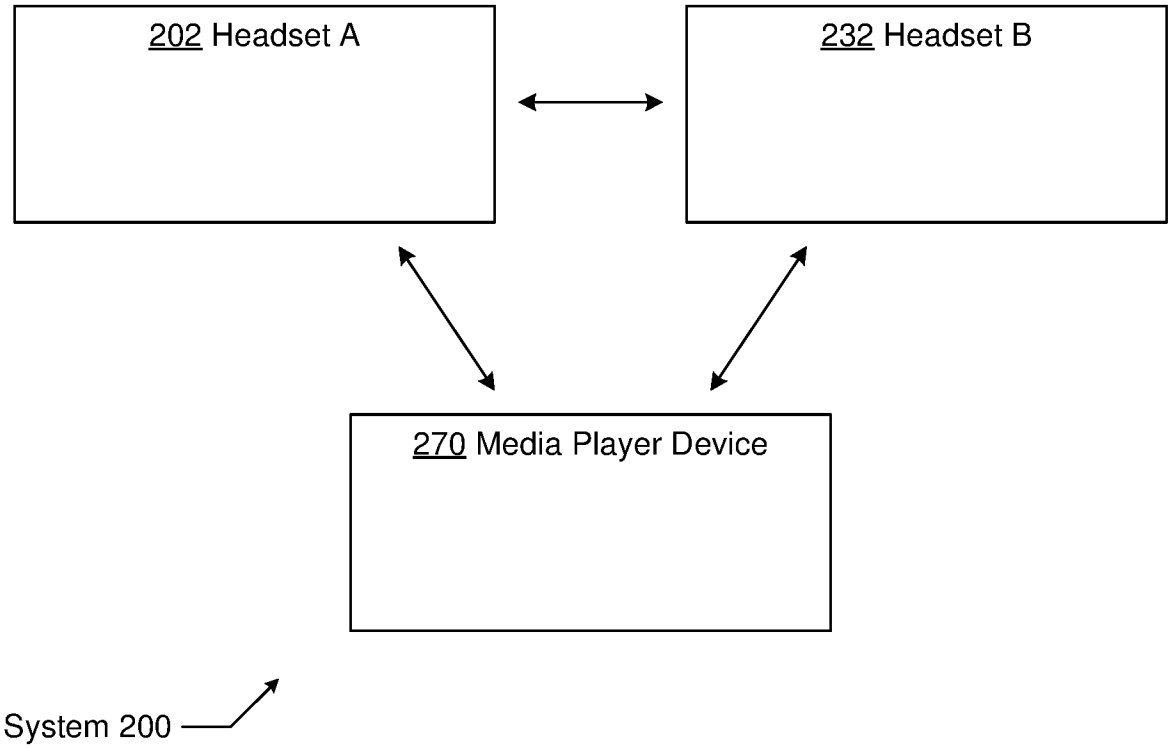

FIG. 1A, FIG. 1B, FIG. 2A, and FIG. 2B show diagrams of systems that are in accordance with the disclosure. FIG. 1A shows a headset (102) that provides directional indications for correct headset orientation. FIG. 1B shows a diagram of the system (100) that includes the headset (102). FIG. 2A shows multiple headsets (202, 232) that provide directional indications for correct headset orientation. FIG. 2B shows a diagram of the system (200) that includes the headsets (202, 232). The embodiments of FIG. 1A, FIG. 1B, FIG. 2A, and FIG. 2B may be combined and may include or be included within the features and embodiments described in the other figures of the application. The features and elements of FIG. 1A, FIG. 1B, FIG. 2A, and FIG. 2B are, individually and as a combination, improvements to the technology of headsets. The various elements, systems, and components shown in FIG. 1A, FIG. 1B, FIG. 2A, and FIG. 2B may be omitted, repeated, combined, and/or altered as shown from FIG. 1A, FIG. 1B, FIG. 2A, and FIG. 2B. Accordingly, the scope of the present disclosure should not be considered limited to the specific arrangements shown in FIG. 1A, FIG. 1B, FIG. 2A, and FIG. 2B.

Turning to FIG. 1A, the headset (102) is a personal audio device for use with multiple ears that provides stereo audio to a user using wired or wireless connections. The headset (102) receives data (wired or wirelessly) and generates audible sound waves as an audio signal that can be heard by a user wearing the headset (102). As an example, the headset (102) may be a headset with boomless mic that fits to the ears (e.g., in-ears, on-ears, or around the ears) of a user.

The housing (104) provides the shape to the headset (102) and contains the components that establish a wired or wireless audio connection. The components of the headset (102) may include the processor (106), the memory (108), the data interface adapter (110), the sensor (114), the battery (116), the first earphone (118), the second earphone (122), and the microphone (126). In one embodiment, one or more system on chips (SoCs) include one or more of the components. For example, a Bluetooth audio SoC may include the processor (106), the memory (108), and the data interface adapter (110).

The processor (106) is a set of one or more processors on one or more discrete integrated circuits that operates the headset (102) by sending and receiving data to the components within the housing (104). In one embodiment, the processor (106) executes instructions from the memory (108) to operate the data interface adapter (110), the speakers (120, 124) of the earphones (118, 122), the microphone (126), and the sensor (114). In one embodiment, the set of processors that make up the processor (106) includes one or more analog to digital converters, digital to analog converters, digital signal processors, central processing units, baseband processors, etc.

The memory (108) is a set of one or more memories that store data and instructions. The data and instructions form the programs that execute and run on the processor (106). The programs are written in languages, which may include assembly language, ANSI C, C++, Python, Java, JavaScript, extensible markup language (XML), etc. The memory (108) includes the definition (109).

The definition (109) is a data structure with one or more values that define the headset (102). As an example, the definition (109) may be a string comprising JavaScript object notation (JSON) text that includes keys and values identifying the manufacturer of the headset (102), the model of the headset (102), and that the headset (102) is a multiple ear headset. An example JSON string is provided below.

```
{
  "Device_Definition": {
  "Manufacturer": "Name",
  "Model": "BOOMLESS MIC HEADSET",
  "Earphones": "2"
  }
}
```

Software instructions in the form of computer readable program code to perform embodiments of the invention may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that, when executed by a processor(s), is configured to perform one or more embodiments of the invention.

The data interface adapter (110) is a set of one or more hardware and software modules. The data interface adapter (110) establishes data connections between the headset (102) and other devices.

In one embodiment, the headset (102) is a wired headset and the data interface adapter (110) operates a wired connection. The wired connection may be in accordance with the universal serial bus (USB) specification. The USB specification is provided by the USB Implementers Forum, Inc. located in Beaverton, Oreg.

In one embodiment, the data interface adapter (110) operates a wireless connection in accordance with the Bluetooth® or Bluetooth® low energy (BLE) specifications for wireless personal area networking. Bluetooth® is a registered trademark of the Bluetooth SIG, Inc., located in Kirkland, Wash.

When the headset (102) is wireless, the housing (104) may include a set of one or more antennas that converts electrical signals back and forth to electromagnetic radio waves. The antennas may include one or more omnidirectional antennas, directional or high gain antennas, parasitic elements, parabolic reflectors, horns, etc., to direct the radio waves into beams and radiation patterns to create wireless data connections with other wireless communication devices (e.g., the media player device (170) of FIG. 1B).

The sensor (114) generates data that identifies whether the headset (102) is being worn by the user. In one embodiment, the sensor (114) is a capacitive sensor that is part of a sensor circuit that provides an interrupt when a change in capacitance satisfies a threshold.

The battery (116) is a source of electrical power used by the electrical components within the headset (102). In one embodiment, the battery (116) is a lithium ion rechargeable battery.

The earphones (118, 122) generate sound heard by the user with the speakers (120, 124). The speakers (120, 124) are each a set of one or more speakers in the headset (102) that converts electrical audio signals into sound that is audible to the user of the headset (102). In one embodiment, the speakers (120, 124) may each include one or more drivers, amplifiers, magnets, voice coils, and electroacoustic transducers that convert digital signals from the processor (106) into audible sound. The first earphone (118) may be designed for a left ear of the user and the second earphone (122) may be designed for a right ear of the user.

The microphone (126) is a set of one or more microphones in the headset (102) that may be positioned in one or both of the earphones (118, 122). The microphone (126) converts sound into an electrical signal. The microphone (126) may include one or more amplifiers, dynamic microphones, condenser microphones, and piezoelectric microphones that convert sound waves into an electronic signal that is received by the processor (106). The microphone (126) may be a boomless mic.

Turning to FIG. 1B, the system (100) includes the headset (102) and the media player device (170). The headset (102) connected to the media player device (170) over a wired or wireless connection. The headset (102) has a wired or wireless connection to the media player device (170) with which to receive data from the media player device (170).

The media player device (170) is any computing device (e.g., mobile device, computer system, call audio endpoint, smartphone, etc.) configured to transmit audio data. The media player device (170) transmits data that includes audio data, that is received by the headset (102). The headset (102) converts the audio data to audible signals that can be heard. The audio data may be from a file stored or buffered on the media player device (170) or from a stream of data received by the media player device (170). The audio data may also be from an call being handled by the media player device (170), e.g., when the media player device (170) is a smartphone. In one embodiment, the media player device (170) is a smartphone and the headset (102) is an over the ear headset with boomless mic.

Turning to FIG. 2A, the headsets (202, 232) are personal audio devices that are each for use with a single ear that, in conjunction, provide stereo audio to a user using wired or wireless connections. The headsets (202, 232) receive data and generate audible sound waves as audio signals that can be heard by a user wearing the headsets (202, 232). As an example, the headsets (202, 232) may be a set of earbuds (wired or wireless) with a size, shape, and configuration to fit within the ears of a user. In one embodiment, the first headset A (202) fits to the left ear of the user and the second headset B (232) fits to the right ear of the user.

The earphone A (218) of the headset A (202) may be adapted to fit to one ear (e.g., left or right) of the user with the hardware and software configured to provide audio for the ear of the user. The earphone B (248) of the headset B (232) may be adapted to fit the other ear of the user with the hardware and software configured to provide audio for the other ear of the user The housing (204) of the headset A (202) provides the shape to the headset A (202) and contains several components of the headset A (202). The processor (206), the memory (208), the data interface adapter (210), the sensor (214), the battery (216), the earphone A (218), the speaker A (220), and the microphone (222) are comparable to the similarly named components from the headset (102) from FIG. 1A and may operate in an analogous fashion.

The memory (208) includes the definition (209), which is a data structure with one or more values that define the headset A (202) and may include a key and value that includes a directional identification of the headset A (202). The directional identification may specify, for example, that the headset A (202) is for a user's left ear and that a left directional indication should be played with the headset A (202). The directional identification may be stored as a string that includes a key value pair. The directional indication may be stored as media file that, when played by the headset (202) through the earphone A (218), provides an audio indication to the user for the proper orientation of the headset A (202). An example JSON string for the definition (209) is provided below.

```
{
  "Device_Definition": {
  "Manufacturer": "Name",
  "Model": "LEFT EARBUD",
  "Earphones": "1"
  }
}
```

The housing (234), as well as the processor (236), the memory (238), the data interface adapter (240), the sensor (244), the battery (246), the earphone B (248), the speaker B (250), and the microphone (252) of the headset B (232) are comparable to the similarly named components from the headset A (202) and may operate in an analogous fashion.

The definition (239) of the memory (238) may be similar to the definition (209) and defines the headset B (232) with keys and values. An example JSON string is provided below.

```
{
  "Device_Definition": {
  "Manufacturer": "Name",
  "Model": "RIGHT EARBUD",
  "Earphones": "1"
  }
}
```

Turning to FIG. 2B, the system (200) includes the headsets (202, 232) and the media player device (270). The headsets (202, 232) may transmit or receive data to and from the media player device (270). Data is transmitted from the media player device (270) to one or both of the headsets (202, 232). In one embodiment, the headsets (202, 232) are wireless earbuds and data that is wirelessly received from the media player device (270) is retransmitted by the headset A (202) to the headset B (232). The headsets (202, 232) may maintain a data connection to share data and settings. For example, the headset A (202) may share a volume setting with the headset B (232). The headset A (202) may send a message to the headset B (232) indicating that a left ear directional indication is playing on the headset A (202), which prevents the headset B (232) from playing a right ear directional indication until after the left ear directional indication is complete.

Figure 3:
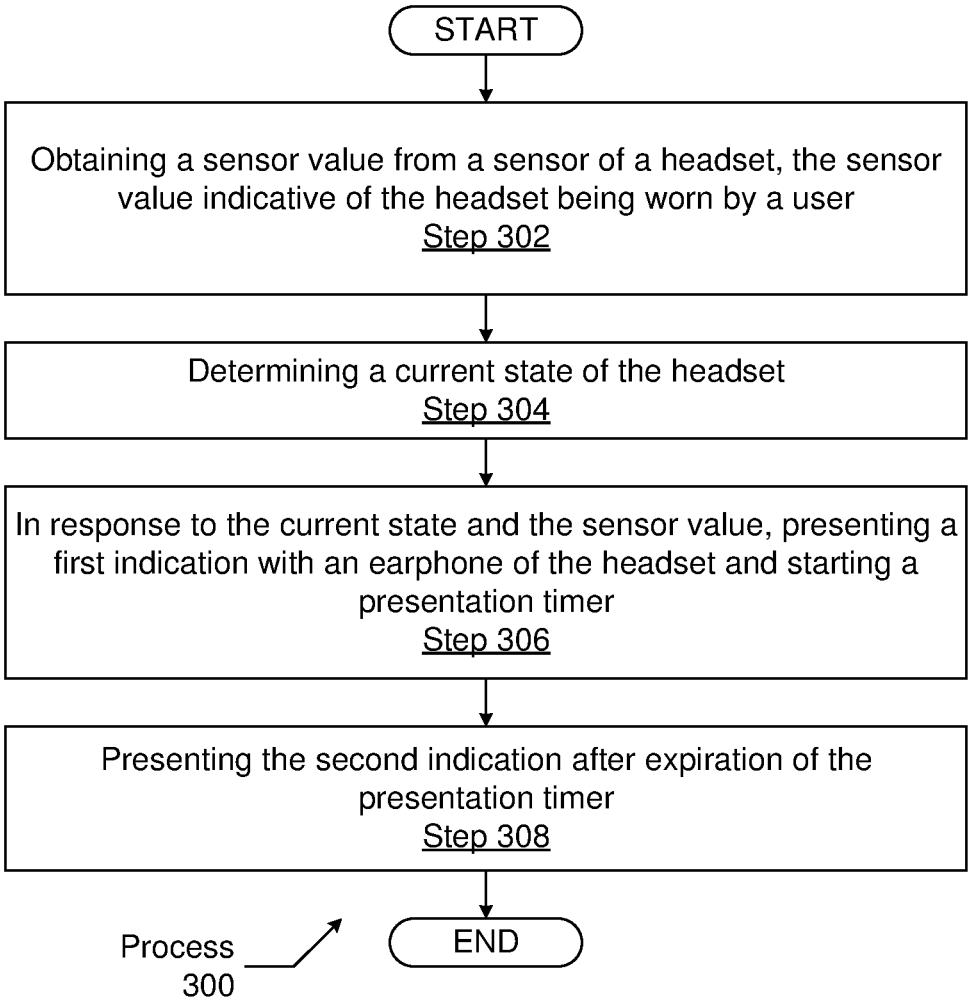
FIG. 3 and FIG. 4 show flowcharts in accordance with disclosed embodiments.
Figure 4:
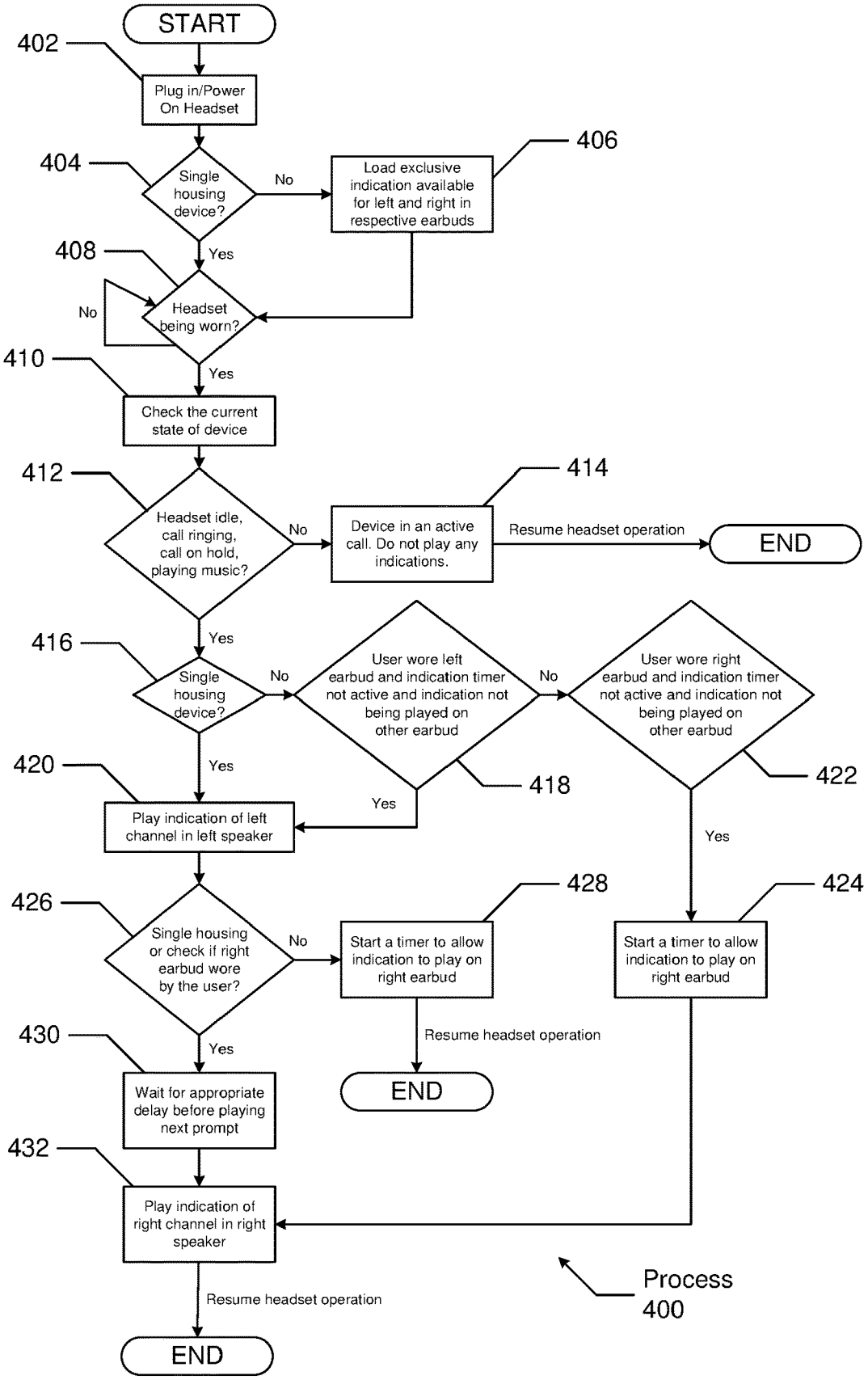

FIG. 3 and FIG. 4 show flowcharts of methods in accordance with one or more embodiments of the disclosure. The processes (300, 400) play indications for correct headset orientation. While the various steps in the flowcharts are presented and described sequentially, one of ordinary skill will appreciate that at least some of the steps may be executed in different orders, may be combined or omitted, and at least some of the steps may be executed in parallel. Furthermore, the steps may be performed actively or passively. For example, some steps may be performed using polling or be interrupt driven in accordance with one or more embodiments. By way of an example, determination steps may not have a processor process an instruction unless an interrupt is received to signify that condition exists in accordance with one or more embodiments. As another example, determinations may be performed by performing a test, such as checking a data value to test whether the value is consistent with the tested condition in accordance with one or more embodiments.

Turning to FIG. 3, in Step 302, a sensor value is obtained from a sensor of a headset. The sensor value may be obtained by the processor of the device receiving a signal from a sensor circuit of the device.

The sensor value indicating the headset being worn by a user. In one embodiment, the sensor value is a binary value that indicates whether the sensor is being touched or worn. For example, when the sensor is a capacitive touch sensor, the measured capacitance may satisfy a threshold that causes the sensor circuit to toggle the sensor value from "0" to "1" to indicate that the device is being touched and worn.

The sensor value may be received when the sensor value transitions from a first sensor value to a second sensor value. The first sensor value indicates that the headset is not being worn (e.g., a value of "0"). The second sensor value may indicate that the headset is being worn (e.g., a value of "1").

In one embodiment, the first directional indication may be presented in response to activation of a button of the headset. The button may be attached to the housing and generate a signal that is received by the processor to trigger playback of the first directional indication.

In step 304, a current state of the headset is determined. The states of the headset may include a device idle state, a call ringing state, a call on hold state, a playing audio media state, an active call state, etc. The device idle state indicates that the device is in idle mode, is not on a call, is not receiving a call, and is not playing audio media. The call ringing state indicates that the device has received an incoming call but has not answered the incoming call. The call on hold state indicates that the device has at least one call in hold. The playing audio media state indicates that the device playing audio media, which may be from streaming media, audio file playback, video file playback, etc. The active call state indicates that the device is on an active call that is not on hold.

In step 306, in response to the current state and the sensor value, a first directional indication is presented with an earphone of the headset and a presentation timer is started. The current state and the sensor value triggers the presentation of the directional indication. The triggering of the presentation and the subsequent presentation may immediately follow the current state and sensor value determination. In one embodiment, the first directional indication is a voice prompt or set of tones played over the speaker of an earphone of the headset.

The first directional indication may identify a coupling type of the earphone of the headset. For example, the first directional indication may be for the left earphone. The first directional indication may be for either the left ear or the right ear based on the default configuration of the system. When the indication is a voice prompt, the indication may state "left earphone" when the left earphone plays the first directional indication and "right earphone" when the right earphone plays the first directional indication. When the indication is a set of tones is used, a first sequence of tones may be used for the left earphone with a different sequence of tones for the right earphone.

The presentation timer prevents the second directional indication from presented while the first directional indication is being presented. The presentation timer may be started by recording a timestamp relative to the current time that indicates the end time of the timer.

In step 308, the second directional indication is presented after expiration of the presentation timer. The presentation timer may expire when the present time of the device is greater than the recorded timestamp.

In one embodiment, the headset is initialized in response to a power signal. The power signal may be received by the processor from the battery of the headset.

In response to initializing the headset, the first directional indication may be loaded without the second directional indication when the headset is a single ear device and when the headset includes a first definition. For example, a headset may be a single ear device or a multiple ear device and the software running on the headset may load one or both of the indications based on the number of earphones of the headset. The first definition defines the headset with keys and values as described above. The process of the headset may identify, from the definition, the directional orientation of the headset (e.g., left or right) and load the corresponding audio media file into system memory. From system memory, the audio media file will be played when it is triggered.

In one embodiment, an incoming call may be answered after presenting the first directional indication in response to receiving the sensor value. The incoming call may be received prior to the headset being worn and answered in response to the sensor of the headset detecting the transition from not being worn to being worn.

In one embodiment, a call on hold may be resumed after presenting the first directional indication in response to receiving the sensor value. The call on hold may be put on hold prior to the headset being worn and resumed in response to the sensor of the headset detecting the transition from not being worn to being worn.

In one embodiment, a repetition prevention timer may be started after presenting the first directional indication. The repetition prevention timer may prevent subsequent presentation of the first directional indication until the repetition prevention timer expires within a defined period of time (e.g., 15 seconds). For example, if the user puts on the headset, takes off the headset, and then puts the headset back on while the repetition prevention timer is active (e.g., within 15 seconds from first putting on the headset), then the first directional indication may not be played since the repetition prevention timer is still active.

In one embodiment, the headset is part of a pair of headsets. An indication signal may be controlled by the software running on a processor of one of the headsets or the indication signal may be transmitted from one headset to the other headset to start the presentation timer on the other headset. The second directional indication may then be presented by the other headset after expiration of the presentation timer.

Turning to FIG. 4, in Step 402, the headset is powered on. For example, the battery of the headset may be installed to provide power to the device or the device may be plugged in to a host system (media player, smartphone, etc.).

In Step 404, a determination is made on the type of housing of the device. If the device is determined to be a single housing device (e.g., a dual earphone headset), then the process (400) proceeds to Step 408. Otherwise, the process (400) proceeds to Step 406.

In Step 406, exclusive directional indications are loaded for the right and left earbuds. For example, after determining from the definition of the device that the device is a left earbud, the device loads the left directional indication into memory.

In Step 408, a sensor is checked to determine if the headset is being worn or not being worn. The sensor (referred to as a Don/Doff sensor) may be checked by reading a sensor value from the sensor chip. The sensor value may be provided to the processor of the headset as an interrupt using a general purpose input output (I/O) pin of the processor. If it is determined that the headset is being worn (e.g., when the interrupt is received), then the process (400) proceeds to Step 410. Otherwise, the process may loop back to Step 408.

In Step 410, the current state of the headset is checked. For example, the device may be in a headset idle state, a call ringing state, a call on hold state, a playing audio media state, an active call state, etc.

In Step 412, if the headset is in the active call state, then the process proceeds to Step 414. In Step 414, the headset is identified as being in an active call and the directional indications are not played by the headset. After identifying that the headset is in an active call state, the headset may resume headset operation. Additionally, a user configurable setting may be included in the headset to enable indications to be played out over the call audio. The user configurable setting may be adjusted in response to user interaction with a button on the headset or in response to an application controlling the configuration of the headset running on a device connected to the headset (e.g., with a smartphone application used to adjust the configuration settings of the headset).

In Step 416, if the headset is a single housing device (e.g., a dual earphone headset), then the process (400) continues to Step 420. Otherwise the process (400) proceeds to Step 418.

In Step 418, when the headset is a first earbud (e.g., a left earbud or right earbud), if a timer preventing playback of an indication is not active, and if an indication is not being played on either earbud of the system, then the process (400) proceeds to Step 420. Otherwise the process (400) proceeds to Step 422.

In Step 420, the first directional indication is played. As an example, the first directional indication may play on the left channel in the left speaker of the headset.

In Step 422, when the headset is a second earbud (e.g., a right earbud), if a timer preventing playback of an indication is not active, and if an indication is not being played on either earbud of the system, then the process (400) proceeds to Step 424. In Step 424, a timer is started to allow the indication to play in the left earbud before the indication is played in the right earbud.

In Step 426, when the headset is a single housing headset or if the right earbud was worn by the user, then the process (400) proceeds to the step 430. Otherwise, the process (400) proceeds to Step 428.

In Step 428, a timer is started to allow the indication to play on the right earbud. After playback, headset operation is resumed (e.g., media playback, call processing, etc.). As an example, the time in Step 428 may be started when the user puts on the right earbud but has not put on the left earbud.

In Step 430, an appropriate delay is waited for before playing the next prompt. The delay may be timed using the timers. An appropriate delay is a length of time to play the first indication (e.g., 2 seconds) with an additional buffer (e.g., 1 second). By waiting the appropriate delay, the user is not confronted with different prompts playing in each ear concurrently.

In Step 432, the second directional indication is played. As an example, the second directional indication may play on the right channel in the right speaker of the headset. After playing the second directional indication, normal headset operation may be resumed.

Figure 5:
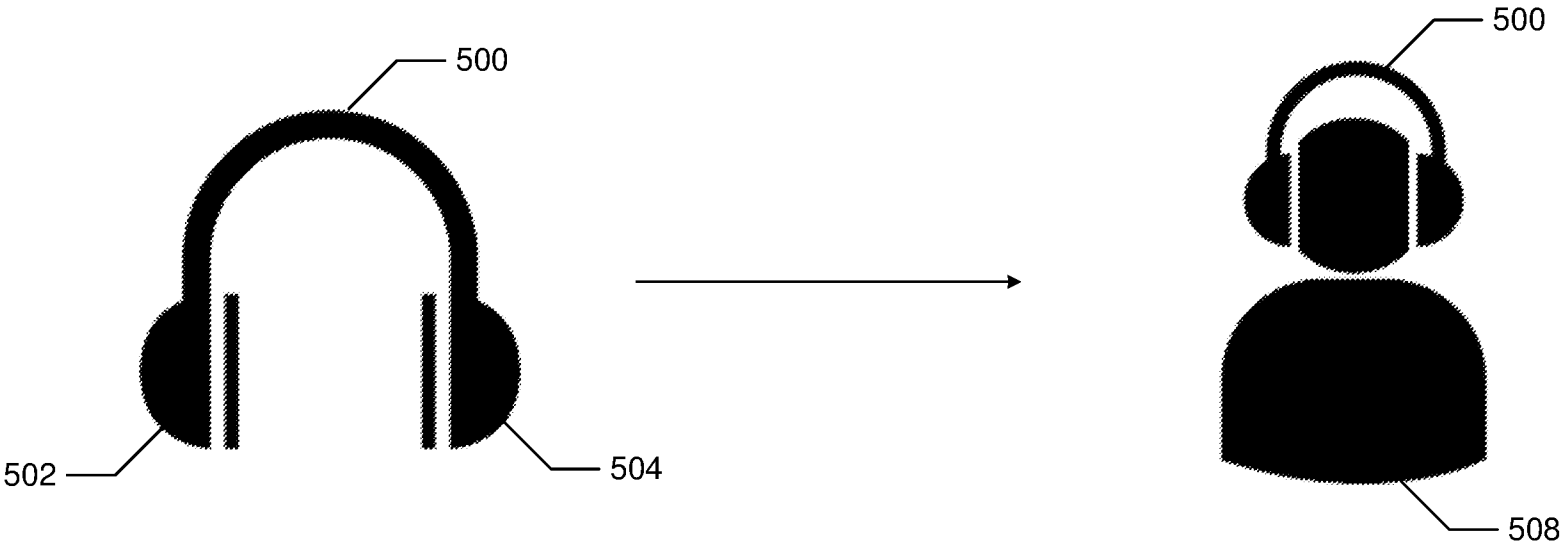
FIG. 5 and FIG. 6 show examples of audio headsets in accordance with disclosed embodiments.
Figure 6:
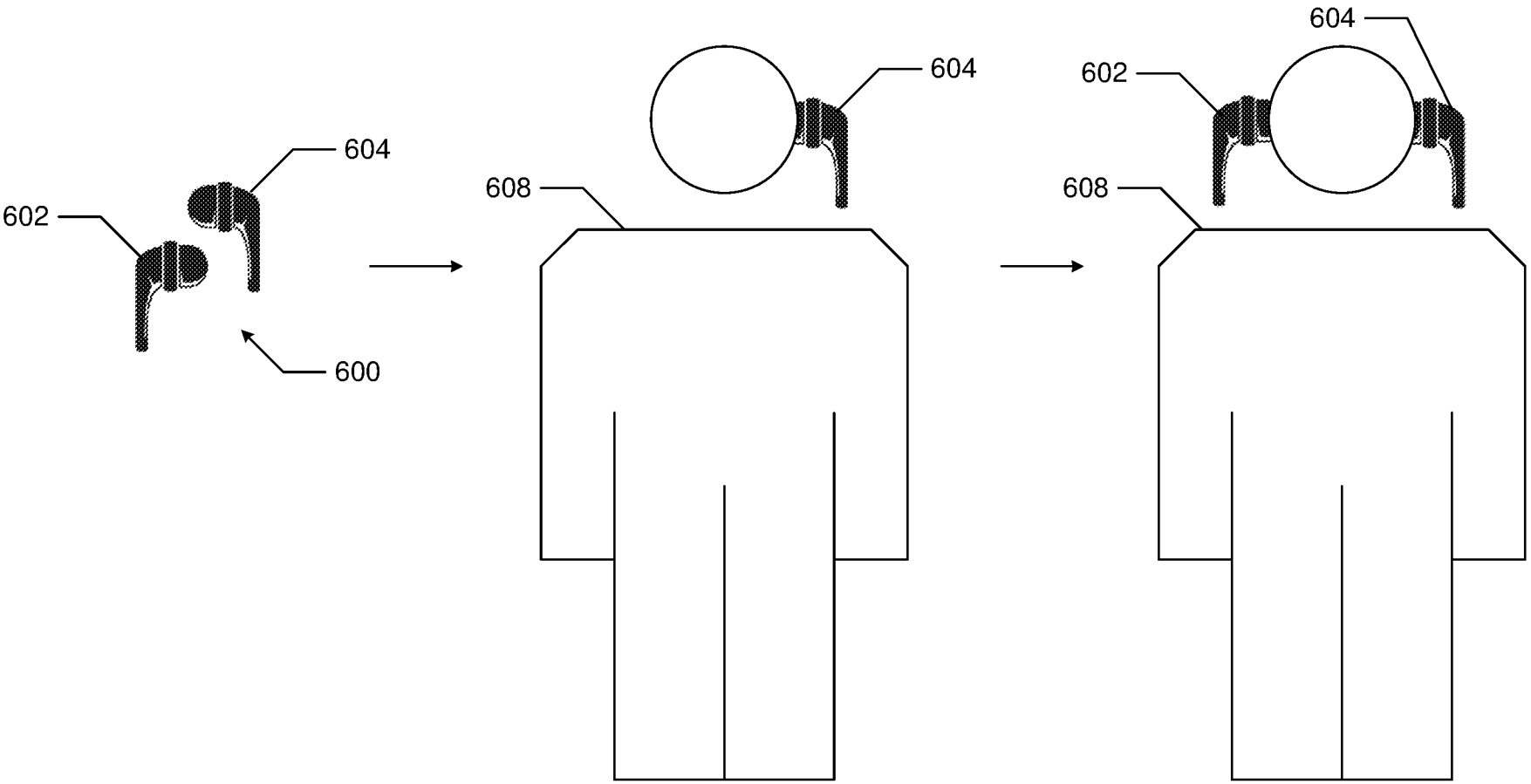

FIG. 5 and FIG. 6 show examples of systems in accordance with the disclosure. FIG. 5 shows an example of a dual earphone headset. FIG. 6 shows an example of two single hear headsets. The embodiments of FIG. 5 and FIG. 6 may be combined and may include or be included within the features and embodiments described in the other figures of the application. The features and elements of FIG. 5 and FIG. 6 are, individually and as a combination, improvements to the technology of headsets and headset systems. The various features, elements, widgets, components, and interfaces shown in FIG. 5 and FIG. 6 may be omitted, repeated, combined, and/or altered as shown. Accordingly, the scope of the present disclosure should not be considered limited to the specific arrangements shown in FIG. 5 and FIG. 6.

Turning to FIG. 5, the headset (500) is a headset and includes the left earphone (502) and the right earphone (504). The left and right earphones (502, 504) respectively fit onto the left and right ears of the user (508). After putting on the headset (500), a directional indication is played in the left earphone (502). After the left directional indication plays, then the right directional indication is played in the right earphone (504). The headset (500) detects that the user has put on the headset (500) with a capacitive sensor that detects touch, proximity, or both.

Turning to FIG. 6, the wireless audio system (600) includes the left earbud (602) and the right earbud (604). The user (608) first puts on the right earbud (604), which is sensed by the right earbud (604). The right earbud (604) plays the right directional indication and the left earbud (602) starts a timer to prevent a left directional indication from playing.

The user (608) then inserts the left earbud (602). The left earbud (602) waits to play the left directional indication until after the timer is expired.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method comprising:

obtaining a sensor value from a sensor of a headset, the sensor value indicating the headset being worn by a user;

determining a current state of the headset; and in response to the current state and the sensor value, presenting a first directional indication with an earphone of the headset and starting a presentation timer, the first directional indication identifying a coupling type of the earphone of the headset, and the presentation timer preventing a second directional indication from being presented.

2. The method of claim 1, further comprising:

presenting the second directional indication after expiration of the presentation timer.

3. The method of claim 1, further comprising:

initializing the headset in response to a power signal; and in response to initializing the headset, loading the first directional indication without the second directional indication when the headset is a single ear device and when the headset includes a definition.

4. The method of claim 1, further comprising:

receiving the sensor value when the sensor value transitions from a first sensor value to a second sensor value, wherein the first sensor value indicates the headset is not being worn, and wherein the second sensor value indicates the headset is being worn.

5. The method of claim 1, further comprising:

presenting the first directional indication in response to activation of a button of the headset, wherein the first directional indication is one of a voice prompt and at least one tone.

6. The method of claim 1, further comprising:

answering an incoming call after presenting the first directional indication in response to receiving the sensor value.

7. The method of claim 1, further comprising:

resuming a call on hold after presenting the first directional indication in response to receiving the sensor value.

8. The method of claim 1, further comprising:

starting a repetition prevention timer after presenting the first directional indication, the repetition prevention timer preventing subsequent presentation of the first directional indication until the repetition prevention timer expires.

9. The method of claim 1, further comprising:

transmitting, by the headset, an indication signal to another headset to start the presentation timer; and presenting the second directional indication, by the other headset, after expiration of the presentation timer.

10. A system comprising:

a processor;

a memory;

a sensor;

an earphone; and the memory comprising an application, wherein the application executes on the processor, uses the memory, and is configured for:

obtaining a sensor value from the sensor, the sensor value indicating the system being worn by a user;

determining a current state of the system; and in response to the current state and the sensor value, presenting a first directional indication with the earphone and starting a presentation timer, the first directional indication identifying a coupling type of the earphone, and the presentation timer preventing a second directional indication from being presented.

11. The system of claim 10, wherein the second directional indication is presented after expiration of the presentation timer.

12. The system of claim 10, wherein the application is further configured for:

initializing the system in response to a power signal; and in response to initializing the system, loading the first directional indication without the second directional indication when the memory includes a definition.

13. The system of claim 10, wherein the application is further configured for:

receiving the sensor value when the sensor value transitions from a first sensor value to a second sensor value, wherein the first sensor value indicates the system is not being worn, and wherein the second sensor value indicates the system is being worn.

14. The system of claim 10, wherein the application is further configured for:

presenting the first directional indication in response to activation of a button of the system, wherein the first directional indication is one of a voice prompt and at least one tone.

15. The system of claim 10, wherein the application is further configured for:

answering an incoming call after presenting the first directional indication in response to receiving the sensor value.

16. The system of claim 10, wherein the application is further configured for:

resuming a call on hold after presenting the first directional indication in response to receiving the sensor value.

17. The system of claim 10, wherein the application is further configured for:

starting a repetition prevention timer after presenting the first directional indication, the repetition prevention timer preventing subsequent presentation of the first directional indication until the repetition prevention timer expires.

18. The system of claim 10, wherein the application is further configured for:

transmitting, by the system, an indication signal to a headset to start the presentation timer; and presenting the second directional indication, by the headset, after expiration of the presentation timer.

19. A system comprising:

a processor;

a memory;

a sensor;

a first earphone;

a second earphone; and the memory comprising an application, wherein the application executes on the processor, uses the memory, and is configured for:

obtaining a sensor value from the sensor, the sensor value indicating the system being worn by a user;

determining a current state of the system;

in response to the current state and the sensor value, presenting a first directional indication with the first earphone and starting a presentation timer, the first directional indication identifying a coupling type of the first earphone, and the presentation timer preventing a second directional indication from being presented; and presenting the second directional indication using the second earphone after expiration of the presentation timer.

20. The system of claim 19, wherein the application is further configured for:

receiving the sensor value when the sensor value transitions from a first sensor value to a second sensor value, wherein the first sensor value indicates the system is not being worn, and wherein the second sensor value indicates the system is being worn.

* * * * *